US009549660B2

(12) United States Patent
Park et al.

(10) Patent No.: US 9,549,660 B2
(45) Date of Patent: Jan. 24, 2017

(54) DISHWASHER

(71) Applicant: SAMSUNG ELECTRONICS CO., LTD., Suwon-si (KR)

(72) Inventors: Nam Soo Park, Suwon-si (KR); Seung Mok Lee, Suwon-si (KR); Jae Won Lee, Hwaseong-si (KR); Young Kyun Jeong, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/282,307

(22) Filed: May 20, 2014

(65) Prior Publication Data

US 2015/0002005 A1 Jan. 1, 2015

(30) Foreign Application Priority Data

Jun. 27, 2013 (KR) ..... 10-2013-0074299

(51) Int. Cl.
*A47L 15/50* (2006.01)

(52) U.S. Cl.
CPC ..... *A47L 15/507* (2013.01); *A47L 15/506* (2013.01)

(58) Field of Classification Search
CPC ..... A47L 15/50; A47L 15/504; A47L 15/506; A47L 15/507
USPC .... 312/228, 228.1, 410, 351, 311; 211/41.8, 211/41.9; 134/56 D
See application file for complete search history.

(56) References Cited

U.S. PATENT DOCUMENTS

| | | | | |
|---|---|---|---|---|
| 3,822,085 | A * | 7/1974 | Clark | 312/351 |
| 5,595,200 | A * | 1/1997 | Favaro | A47L 15/504 134/201 |
| 6,247,771 | B1 * | 6/2001 | Miller | 312/310 |
| 2004/0163687 | A1 * | 8/2004 | Son et al. | 134/58 D |
| 2006/0066189 | A1 | 3/2006 | Bond et al. | |
| 2008/0129168 | A1 | 6/2008 | Banta et al. | |
| 2009/0009040 | A1 * | 1/2009 | Dellby et al. | 312/228.1 |
| 2010/0045152 | A1 * | 2/2010 | Bond et al. | 312/319.1 |
| 2012/0074080 | A1 | 3/2012 | Garcia et al. | |

FOREIGN PATENT DOCUMENTS

| | | |
|---|---|---|
| DE | 20 2009 004771 U1 | 9/2010 |
| KR | 1995-0010856 | 5/1995 |
| KR | 10-2005-0081446 | 8/2005 |

OTHER PUBLICATIONS

European Search Report dated Nov. 14, 2014 issued in corresponding European Patent Application 14171655.5-1710.

* cited by examiner

*Primary Examiner* — James O Hansen
(74) *Attorney, Agent, or Firm* — Staas & Halsey LLP

(57) ABSTRACT

A dishwasher having an improved structure by which a basket is easily withdrawn, the dishwasher including a case, a basket arranged within the case to receive objects to be washed, a rail provided on an inner wall of the case in order to guide the basket such that the basket is withdrawn forward of the case, a link unit mounted to the basket to lift the basket, and an auxiliary unit connected to the link unit such that lifting force acts on the basket based on a position of the basket.

22 Claims, 10 Drawing Sheets

DISHWASHER

CROSS-REFERENCE TO RELATED APPLICATIONS

This application claims the benefit of Korean Patent Application No. 10-2013-0074299, filed on Jun. 27, 2013 in the Korean Intellectual Property Office, the disclosure of which is incorporated herein by reference.

BACKGROUND

1. Field

The following description relates to a dishwasher having an improved structure by which a basket is easily withdrawn.

2. Description of the Related Art

In general, a dishwasher is a device spraying high pressure wash water onto one or more objected to be washed such as dishes to wash the objects and typically undergoes a preliminary washing process, for example, a main washing process, a rinsing process, and a drying process. Dishwashing is performed by spraying only wash water without detergent to wash contaminants off of the objects in the preliminary washing process, and then simultaneously inserting detergent using a detergent supply unit while spraying wash water in the main washing process.

The dishwasher typically includes a cabinet provided with a washing bath therein, a pump to generate a wash water pressure, a basket which receives objects to be washed and is installed movably in a forward and backward direction within the washing bath, spray units to spray wash water onto the basket, a connection passage through which the pump and the spray units are connected, and a passage switching valve to selectively move wash water from the pump to the multiple spray units, thereby washing the objects to be washed by the wash water sprayed from the spray units.

The basket includes an upper basket provided at an upper portion of the washing bath and a lower basket provided at a lower portion thereof.

Since the lower basket has a structure to store the objects to be washed in a state of being arranged at the lower portion of the washing bath and moving forward, the objects may be inserted into or withdrawn from the lower basket in a state in which a user bends down. Therefore, this may very inconvenient for the user and may not be good for the user's health. In particular, in terms of a structure of the dishwasher, the lower basket is relatively larger in size than the upper basket and heavy objects are received in the lower basket and washed. Accordingly, it may be hard to insert or withdraw these objects into or from the lower basket.

SUMMARY

Therefore, it is an aspect of the present disclosure to provide a dishwasher having a structure capable of improving user experience when a basket is withdrawn.

It is another aspect of the present disclosure to provide a dishwasher having an improved structure capable of stably storing objects to be washed such as dishes by stably and fixedly maintaining a basket in a state in which the basket is lifted.

It is a further aspect of the present disclosure to provide a dishwasher having an improved structure capable of preventing shock from being applied to objects to be washed by not allowing a basket to rapidly drop or move downward quickly.

Additional aspects of the disclosure will be set forth in part in the description which follows and, in part, will be apparent from the description, or may be learned by practice of the disclosure.

In accordance with an aspect of the present disclosure, a dishwasher includes a case, a basket arranged within the case to receive objects to be washed, a rail provided on an inner wall of the case in order to guide the basket such that the basket is withdrawn forward of the case, a link unit mounted to the basket to lift the basket, and an auxiliary unit connected to the link unit such that lifting force acts on the basket based on a position of the basket.

The link unit may include a first plate coupled to a plurality of first rollers moving forward of the case along the rail, a second plate provided, at an end portion thereof, with a basket holder portion coupled to the basket, a first rotation shaft being formed at a position at which the first plate and the second plate are coupled, and a third plate coupled to the second plate by a fixing member so as to be rotated together with the second plate, a second rotation shaft being formed at a position at which the first plate and the third plate are coupled.

The dishwasher may further include an auxiliary rail installed on the inner wall of the case in parallel with the rail, the auxiliary rail having a front end portion positioned farther rearward than that of a support.

The third plate may have a second roller, which moves forward of the case along the auxiliary rail and is formed at an end portion thereof in a direction away from the second rotation shaft.

The third plate may be rotated about the second rotation shaft toward the front of the case in order to lift the basket when the second roller is decoupled from the auxiliary rail toward the front of the case such that the link unit lifts the basket at a distal end portion of the rail withdrawn outward of the case.

The dishwasher may further include a first coupling shaft by which the auxiliary unit is mounted to the third plate, and a second coupling shaft by which the auxiliary unit is mounted to the first plate, wherein when the first coupling shaft is positioned below a reference line defined by the second coupling shaft and the second rotation shaft, the basket may be lifted as the third plate is rotated about the second rotation shaft toward the front of the case.

The dishwasher may further include a lever unit which is provided between the auxiliary unit and the third plate and is mounted to the first plate, the lever unit being moved down to a position reaching the auxiliary rail when the third plate is rotated about the second rotation shaft toward the front of the case.

When external force is applied to the lifted basket toward the rear of the case, the lever unit may contact a front surface portion of the auxiliary rail in order to prevent the basket from moving rearward of the case.

The dishwasher may further include a locking unit mounted outside the basket holder portion so as to fix or secure the lifted basket.

The locking unit may be mounted, at one end portion thereof, outside the basket holder portion, and be provided, at the other end portion thereof, with a fixing groove opened in a direction opposite to a withdrawal direction of the basket such that the fixing groove engages with a fixing portion, which is formed at the third plate and protrudes in a direction away from the basket.

The dishwasher may further include a release unit, which is connected to the locking unit and moves the locking unit in the withdrawal direction of the basket, thereby allowing the fixing groove to be moved away from the fixing portion.

The fixing portion may be decoupled from the fixing groove when the release unit is operated, thereby allowing the third plate to enter a state rotatable about the second rotation shaft, and when external force is applied to the basket, the basket may drop or moves downward until a first coupling shaft is positioned above a reference line defined by a second coupling shaft and the second rotation shaft.

The auxiliary unit may use at least one of expansion forces of a gas, a fluid, and a spring compressed within a cylinder, in order to relieve vibration or shock applied to the basket.

The auxiliary unit may be configured such that at least one auxiliary unit is provided at the link unit.

In accordance with another aspect of the present disclosure, a dishwasher includes a case, a basket arranged within the case to receive objects to be washed, rails which engage with supports installed at both inner walls of the case to move forward and rearward of the case, in order to guide the basket such that the basket is withdrawn forward of the case, a first link unit and a second link unit which are mounted to both side surface portions of the basket so as to lift the basket, and a first auxiliary unit and a second auxiliary unit which are connected to the first link unit and the second link unit such that lifting force acts on the basket based on a position of the basket.

Each of the first link unit and the second link unit may include a first plate coupled to a plurality of first rollers moving forward of the case along the corresponding rail, a second plate provided, at an end portion thereof, with a basket holder portion coupled to the basket, a first rotation shaft being formed at a position at which the first plate and the second plate are coupled, and a third plate coupled to the second plate so as to be rotated together with the second plate, a second rotation shaft being formed at a position at which the first plate and the third plate are coupled, and when a first coupling shaft by which the first auxiliary unit or the second auxiliary unit is mounted to the third plate is positioned below a reference line defined by a second coupling shaft by which the first auxiliary unit or the second auxiliary unit is mounted to the first plate and the second rotation shaft, the basket may be lifted as the third plate is rotated about the second rotation shaft toward the front of the case.

In order to uniformly maintain force required to lift the basket and advance a point of time to lift the basket, the first coupling shaft moving closer to the reference line may differ according to the first auxiliary unit and the second auxiliary unit.

The dishwasher may further include auxiliary rails installed at both inner walls of the case in parallel with the rails, the auxiliary rails having front ends positioned farther rearward than those of the supports.

The dishwasher may further include a lever unit which is provided between the first or second auxiliary unit and the third plate and is mounted to the first plate, the lever unit being moved down to a position reaching the corresponding auxiliary rail when the third plate is rotated about the second rotation shaft toward the front of the case.

The dishwasher may further include a locking unit, which is mounted, at one end portion thereof, outside the basket holder portion so as to fix or secure the lifted basket, and is provided, at the other end portion thereof, with a fixing groove opened in a direction opposite to a withdrawal direction of the basket such that the fixing groove engages with a fixing portion, which is formed at the third plate and protrudes in a direction away from the basket.

The dishwasher may further include a release unit, which is connected to the locking unit by a connection member and has a shape protruding toward a front upper end portion of the basket, wherein when the release unit is operated, the fixing groove may be pulled in the withdrawal direction of the basket by the connection member so as to be away from the fixing portion.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
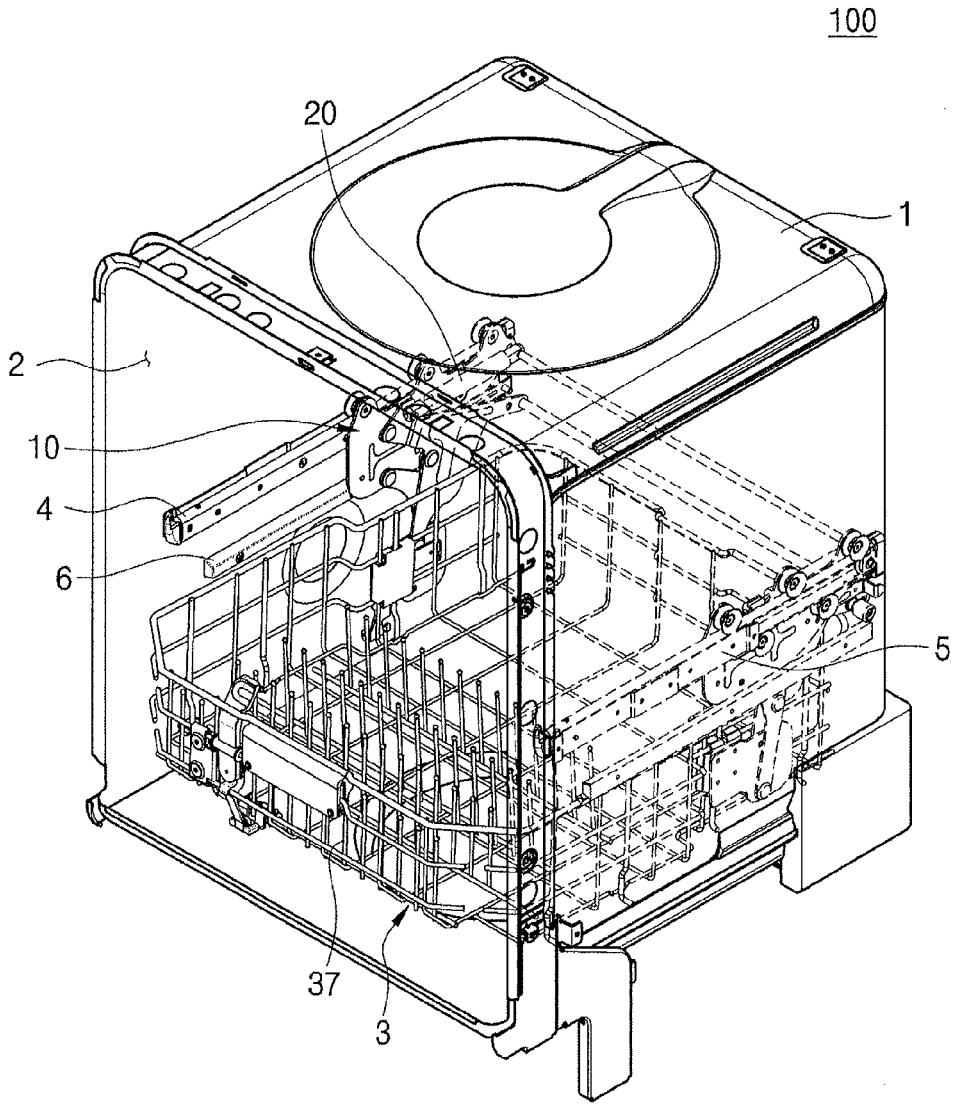
FIG. 1 is a perspective view illustrating a configuration of a dishwasher according to an embodiment of the present disclosure.

Reference will now be made in detail to embodiments of the present disclosure, examples of which are illustrated in the accompanying drawings, wherein like reference numerals refer to like components throughout. Herein, an upper basket may also be omitted in the drawings.

FIG. 1 is a perspective view illustrating a configuration of a dishwasher according to an embodiment of the present disclosure.

As shown in FIG. 1, a dishwasher 100 according to an embodiment of the present disclosure includes a case 1 defining an external appearance thereof and a washing bath 2 provided inside the case 1 to perform dishwashing. The washing bath 2 is provided, at a lower portion thereof, with a sump (not shown) to store wash water.

The case 1 is opened at a front surface portion thereof so that one or more objects to be washed such as dishes may be received in or withdrawn from the washing bath 2, and a door (not shown) is installed to the front surface portion of the case 1 so as to open and close the washing bath 2. The door is hinge-coupled to and pivoted about a front lower portion of the case 1 so that the washing bath 2 is opened and closed.

In the washing bath 2, a plurality of baskets 3 provided with storage portions, upper portions of which are opened to receive the objects, are respectively installed to the upper and lower portions of the washing bath 2 so as to be movable in a forward and backward direction.

Each of the baskets 3 is withdrawn or inserted through the opened front surface portion of the case 1 by at least one rail 4 to slidably move the basket 3.

The rail 4 engages with a support 5 fixed to an inner wall of the case 1, and may move along the inner wall of the case 1 in the forward and backward direction by at least one roller (not shown) provided between the rail 4 and the support 5.

The basket 3 is formed by wires 37 arranged in a lattice form such that the dishes received in the basket 3 may be washed by being exposed outward thereof.

A spray unit (not shown) to spray wash water onto the basket 3 is mounted on at least one surface portion of the washing bath 2. The spray unit may include an upper spray unit and a lower spray unit to respectively spray water onto the upper and lower baskets, but the present disclosure is not limited thereto.

The washing bath 2 may be provided with link units 10, auxiliary units 20, and auxiliary rails 6.

The link units 10 may be fixed to an outer portion of the basket 3 and lift the basket 3.

The auxiliary units 20 may be connected to the corresponding link unit 10 such that lifting force acts on the basket 3 based on a position of the basket 3.

The auxiliary rails 6 may prevent the basket 3 from being lifted within the case 1 in a state of being improperly withdrawn, and may be installed on the inner wall of the case 1 in parallel with the rail 4.

In addition, the auxiliary rail 6 may have a shorter length than the support 5 in the front of the case 1. In other words, the auxiliary rail 6 may have a front end portion positioned farther rearward of the case 1 than that of the support 5.

The auxiliary rail 6 may be formed in a bead shape recessed toward the inside of the case 1 as well as being a separate member.

Figure 2:
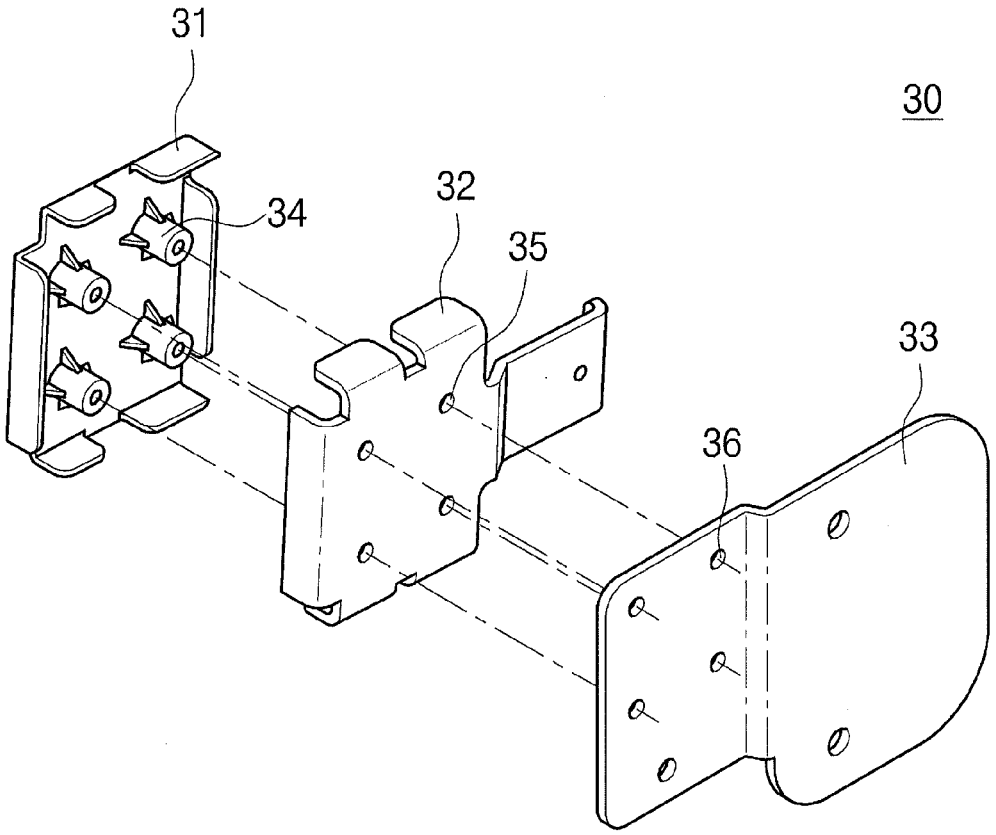
FIG. 2 is a perspective view illustrating a basket holder portion in the dishwasher according to an embodiment of the present disclosure.
Figure 3:
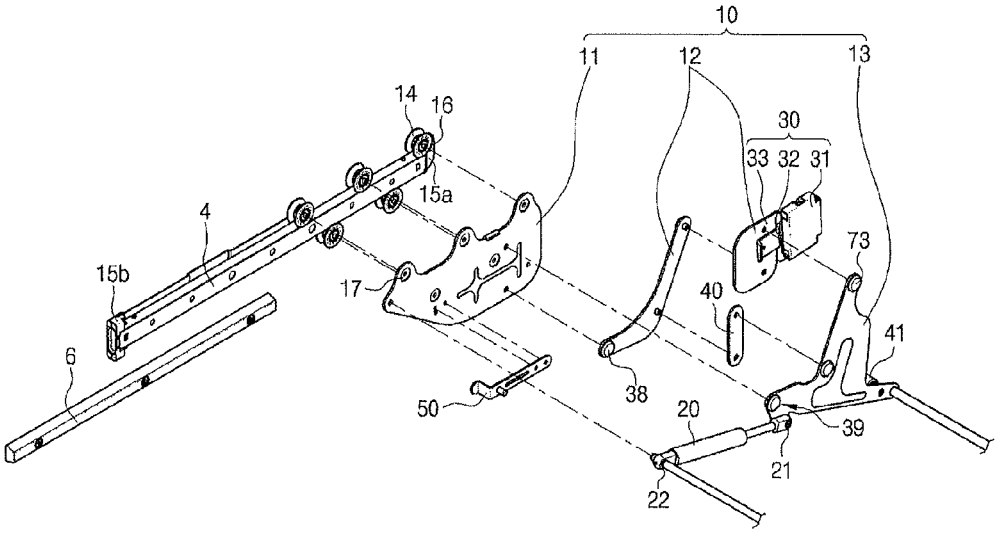
FIG. 3 is an exploded perspective view illustrating a partial configuration of the dishwasher according to an embodiment of the present disclosure.

FIG. 2 is a perspective view illustrating a basket holder portion in the dishwasher according to an embodiment of the present disclosure. FIG. 3 is an exploded perspective view illustrating a partial configuration of the dishwasher according to an embodiment of the present disclosure.

As shown in FIGS. 2 and 3, the link unit 10 may include a first plate 11, a second plate 12, and a third plate 13.

The first plate 11 is coupled to a plurality of first rollers 14 moving forward of the case 1 along the rail 4, and thus may move in a longitudinal direction of the rail 4.

The rail 4 may be provided, at end portions thereof, with stoppers 15 so as not to decouple the plurality of first rollers 14. The stoppers 15 may include a first stopper 15*a* and a second stopper 15*b*.

A first stopper 15*a* formed at an end portion of the rail 4 located forward of the case 1, may have a projection portion 16 bent in a withdrawal direction of the basket 3 to engage with the corresponding first roller 14.

A second stopper 15*b* is formed at the other end portion of the rail 4, and the rail 4 may move forward of the case 1 until the second stopper 15*b* reaches an end portion of the support 5.

The first plate 11 may be formed, on a surface portion thereof, with a plurality of fixing holes 17 corresponding to positions and numbers of the plurality of first rollers 14 such that the first plate 11 may be coupled to the plurality of first rollers 14.

The second plate 12 may be mounted to the first plate 11, and may be provided, at one end portion thereof, with a basket holder portion 30 coupled to the basket 3.

As shown in FIG. 2, the basket holder portion 30 may include a first cover 31, a second cover 32, and a third cover 33.

The first cover 31 may be formed with a plurality of protrusion portions 34 protruding toward the inner wall of the case 1, and the second cover 32 may be formed with a plurality of first mounting holes 35 corresponding to the plurality of protrusion portions 34. In addition, the third cover 33 may be formed with a plurality of second mounting holes 36 corresponding to the first mounting holes 35 so as to fix the first and second covers 31 and 32.

The plurality of protrusion portions 34 and the plurality of first mounting holes 35 face each other while interposing the lattice shaped wires 37 configuring the basket 3 therebetween. Thereby, the first cover 31 arranged at an inner portion of the basket 3 and the second cover 32 arranged at an outer portion of the basket 3 are mounted to each other inside the basket 3.

The third cover 33 is arranged outside the second cover 32, and fixing members (not shown) pass through the plurality of second mounting holes 36 arranged at the third cover 33 and the plurality of first mounting holes 35 arranged at the second cover 32 and are then inserted into the plurality of protrusion portions 34 arranged at the first cover 31, respectively. Consequently, the first cover 31 and the second cover 32 are fixed while interposing the wires 37 of the basket 3 therebetween.

A first rotation shaft 38 may be formed at a position at which the second and first plates 12 and 11 are coupled.

The third plate 13 is coupled to the first plate 11, and a second rotation shaft 39 may be formed at a position at which the third and first plates 13 and 11 are coupled.

One end portion of the third plate 33 is positioned between the second and third covers 32 and 33 of the basket holder portion 30, and is fixed to the third cover 33 by a fixing member 73.

Accordingly, the second and third plates 12 and 13 may share the load of the basket 3 mounted to the basket holder portion 30.

The third plate 13 may be coupled to the second plate 12 by a fixing member 40 provided between the second and third plates 12 and 13.

Basically, the second plate 12 is rotatable about the first rotation shaft 38, and the third plate 13 is rotatable about the second rotation shaft 39. However, the second and third plates 12 and 13 may be rotated together about the first and second rotation shafts 38 and 39 since the second and third plates 12 and 13 are coupled by the fixing member 40.

The third plate 13 may be formed, at an end portion thereof, with a second roller 41.

The second roller 41 may be provided at the end portion of the third plate 13 in a direction away from the second rotation shaft 39, and may forwardly and backwardly move along the auxiliary rail 6 in a longitudinal direction thereof.

At least one second roller 41 may be provided.

The auxiliary unit 20 may be mounted to the third plate 13. The auxiliary unit 20 prevents vibration or shock from being applied to the basket 3 and the objects received in the basket 3 when the basket 3 is lifted or dropped.

The auxiliary unit 20 may be mounted, at one end portion thereof, to the third plate 13, and be mounted, at the other end portion thereof, to the first plate 11.

A first coupling shaft 21 is formed by mounting of the auxiliary unit 20 to the third plate 13, and a second coupling shaft 22 is formed by mounting of the auxiliary unit 20 to the first plate 11. The first coupling shaft 21 and the second coupling shaft 22 may be integrated to the auxiliary unit 20. For example, the first coupling shaft 21 may be provided at one end portion of the auxiliary unit 20, and the second coupling shaft 22 may be provided at the other end portion of the auxiliary unit 20.

The auxiliary unit 20 may use at least one of expansion force of a gas, a fluid, and a spring compressed within a cylinder.

At least one auxiliary unit 20 may be provided at the link unit 10.

The first plate 11 may be mounted with a lever unit 50.

The lever unit 50 prevents the basket 3 from moving rearward of the case 1 when external force is applied to the lifted basket 3 toward the rear of the case 1. The lever unit 50 fixed to the first plate 11 may be positioned between the auxiliary unit 20 and the third plate 13.

Figure 4:
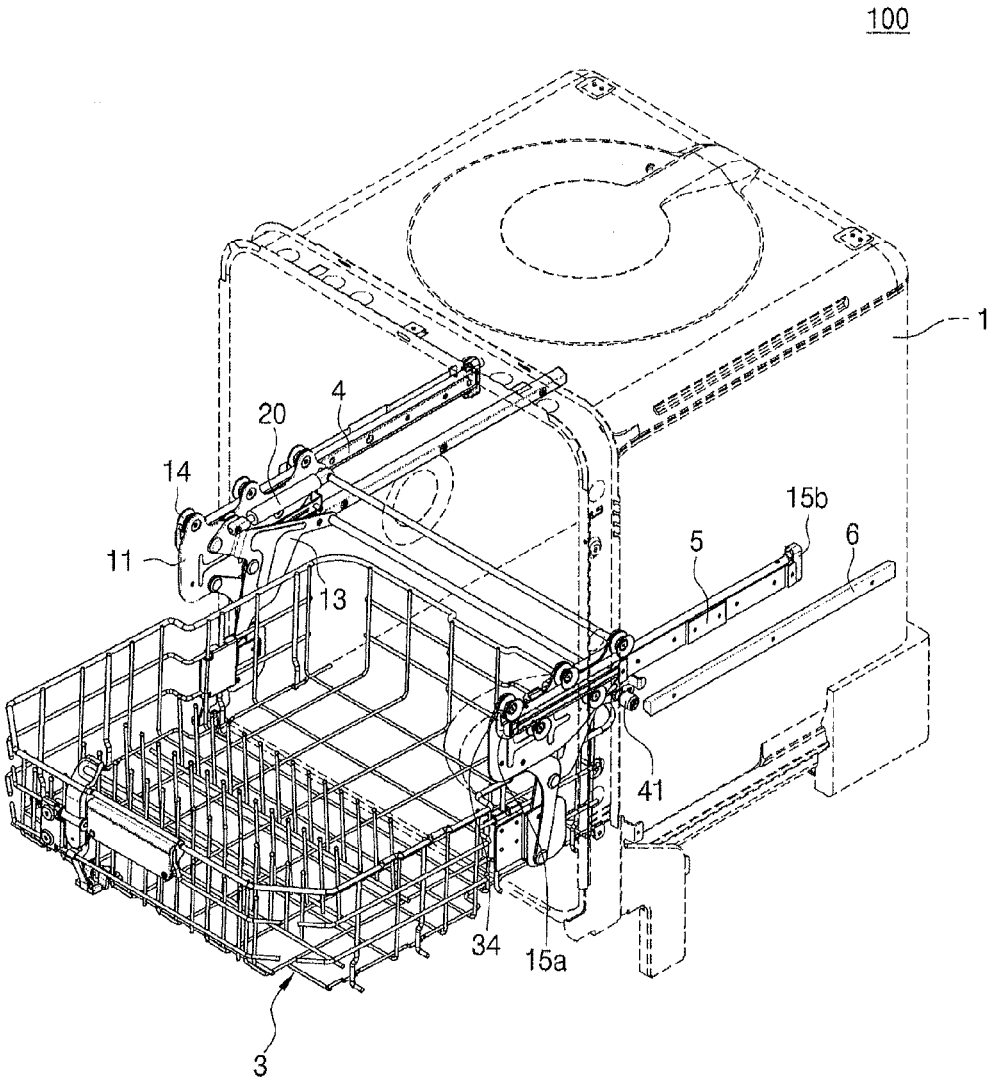
FIG. 4 is a perspective view illustrating a state in which a basket is withdrawn from the dishwasher according to an embodiment of the present disclosure.
Figure 5:
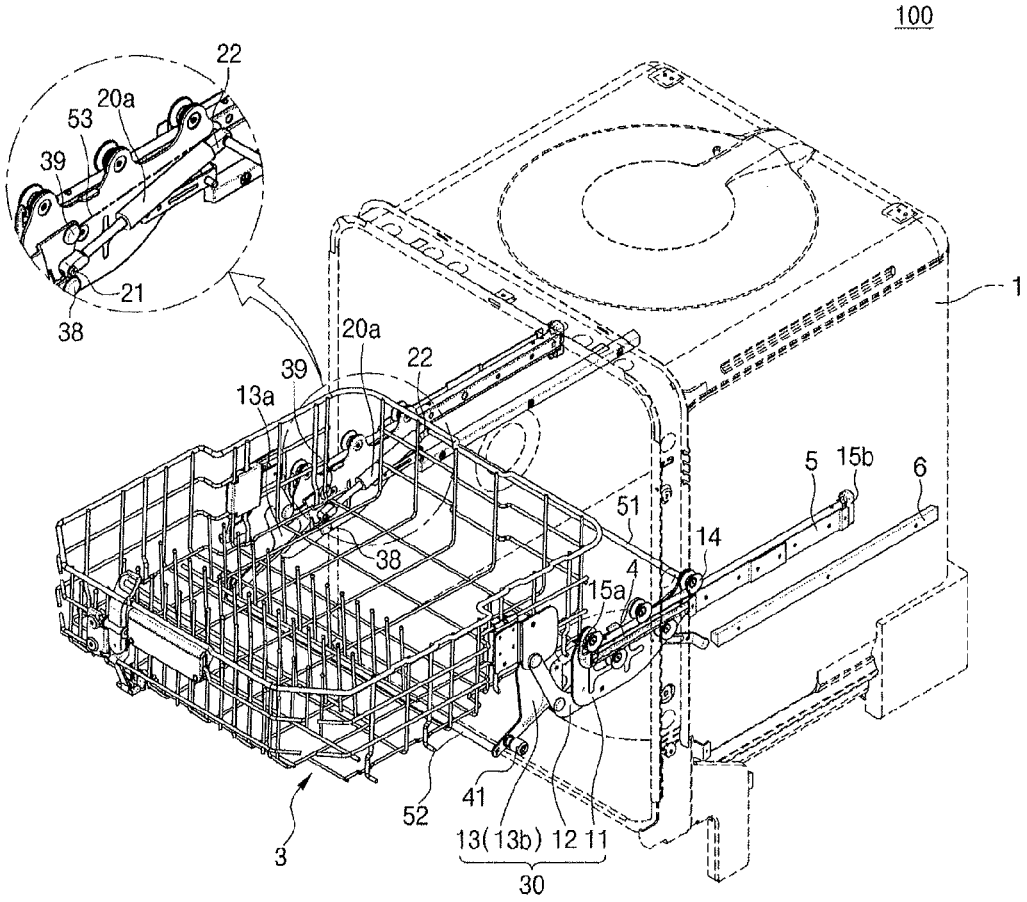
FIG. 5 is a perspective view illustrating a state in which the basket is lifted in the dishwasher according to an embodiment of the present disclosure.

FIG. 4 is a perspective view illustrating a state in which the basket is withdrawn from the dishwasher according to an embodiment of the present disclosure. FIG. 5 is a perspective view illustrating a state in which the basket is lifted in the dishwasher according to an embodiment of the present disclosure.

As shown in FIG. 4, the basket 3 may be withdrawn outward of the case 1 along the rail 4.

Specifically, the plurality of first rollers 14 coupled to the first plate 11 move forward of the case 1 along the rail 4, and the second roller 41 coupled to the third plate 13 moves forward of the case 1 along the auxiliary rail 6.

The plurality of first rollers 14 move forward of the case 1 until the first rollers 14 are caught by the projection portion 16 formed at the first stopper 15*a* provided at one end portion of the rail.

Since the stoppers 15 are provided at the auxiliary rail 6, the second roller 41 is decoupled from a position at which the auxiliary rail 6 ends in a longitudinal direction thereof.

The auxiliary rail 6 may have a distal end portion which is at a position equal to or shorter than that of the support 5 in the front portion of the case 1.

The rail 4 may move forward of the case 1 until the second stopper 15*b* provided at the other end portion of the rail 4 is caught by the end portion of the support 5.

When the first rollers 14 are caught by the projection portion 16 formed at the first stopper 15*a* and are not moved forward of the case 1 any longer, the second roller 41 may already be decoupled from the auxiliary rail 6.

As shown in FIG. 5, the basket 3 may be lifted as the third plate 13 is rotated about the second rotation shaft 39 toward the front portion of the case 1.

Specifically, when the first coupling shaft 21 is positioned below a reference line 53 defined by the second coupling shaft 22 and the second rotation shaft 39, the basket 3 is lifted.

On the contrary, when the first coupling shaft 21 is positioned above the reference line 53 defined by the second coupling shaft 22 and the second rotation shaft 39, the basket 3 drops or moves downward.

When the first coupling shaft 21 is positioned on the reference line 53 defined by the second coupling shaft 22 and the second rotation shaft 39, the basket 3 is not moved.

The respective link units 10 and the respective auxiliary units 20 may be provided at both inner walls of the case 1.

The link units 10 provided at both inner walls of the case 1 are respectively referred to as a first link unit 10*a* and a second link unit 10*b*. The auxiliary unit 20 mounted to the first link unit 10*a* is referred to as a first auxiliary unit 20*a* and the auxiliary unit 20 mounted to the second link unit 10*b* is referred to as a second auxiliary unit (not shown).

The first auxiliary unit 20*a* and the second auxiliary unit (not shown) are connected to each other by a first shaft 51, and a third plate 13*a* of the first link unit 10*a* is connected to a third plate 13*b* of the second link unit 10*b* by a second shaft 52.

The first coupling shaft 21 rapidly moves upward or downward of the reference line 53 as the first coupling shaft 21 moves closer to the reference line 53. Therefore, a point of time to lift the basket 3 may be advanced, whereas greater force may be needed to lift the basket 3.

Accordingly, in order to uniformly maintain the force required to lift the basket 3 and advance the point of time to lift the basket 3, the first coupling shaft 21 moving closer to the reference line 53 may differ according to the first auxiliary unit 20*a* and the second auxiliary unit (not shown).

In addition to this, the first auxiliary unit 20*a* and the second auxiliary unit (not shown) may have different expansion forces from each other.

Figure 6:
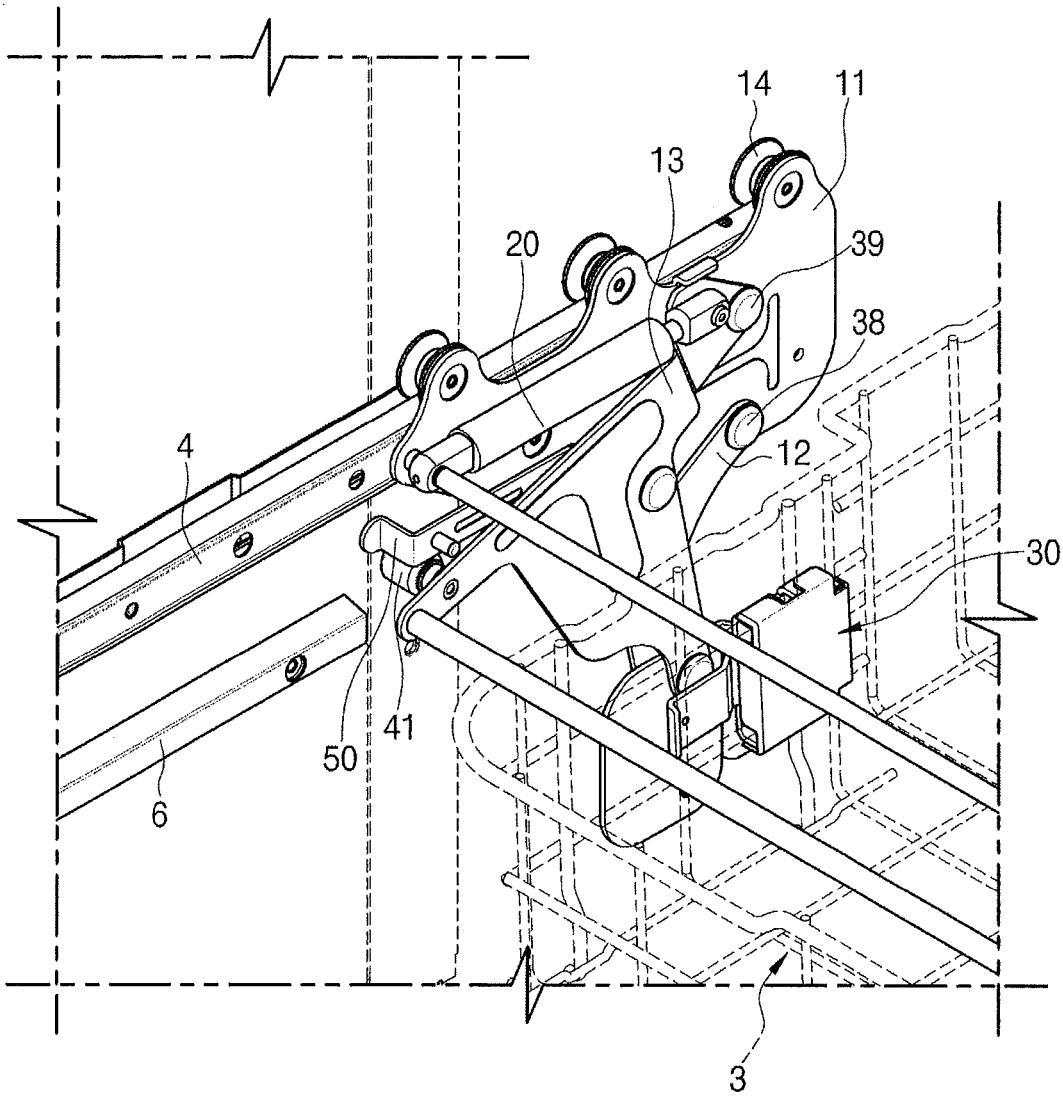
FIG. 6 is a perspective view illustrating a state in which a second roller is decoupled from an auxiliary rail in the dishwasher according to an embodiment of the present disclosure.
Figure 7:
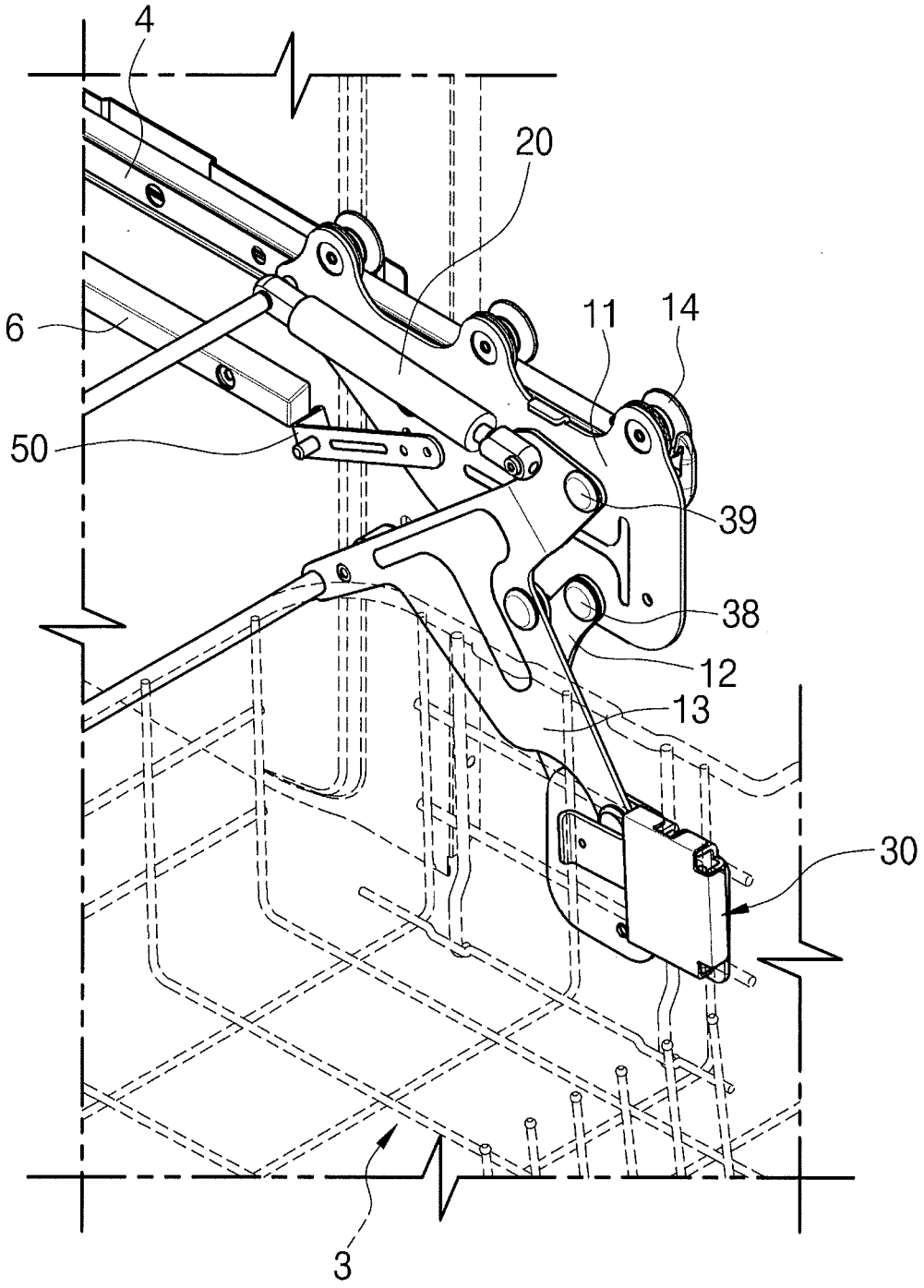
FIG. 7 is a perspective view illustrating a state in which external force is applied to the lifted basket toward the rear of a case in the dishwasher according to an embodiment of the present disclosure.

FIG. 6 is a perspective view illustrating a state in which the second roller is decoupled from the auxiliary rail in the dishwasher according to an embodiment of the present disclosure. FIG. 7 is a perspective view illustrating a state in which external force is applied to the lifted basket toward the rear of the case in the dishwasher according to an embodiment of the present disclosure.

As shown in FIGS. 6 and 7, the second roller 41 is decoupled from the auxiliary rail 6, and thus the third plate 13 enters a state rotatable about the second rotation shaft 39 toward the front of the case 1.

The second and third plates 12 and 13 are rotated about the first and second rotation shafts 38 and 39 toward the front portion of the case 1 while the first coupling shaft 21 moves downward of the reference line 53, thereby allowing the basket 3 mounted to the basket holder portion 30 to be lifted.

The lever unit 50 mounted to the first plate 11 may be positioned between the rail 4 and the auxiliary rail 6 when the second roller 41 moves along the auxiliary rail 6, and may be moved down to a position reaching the auxiliary rail 6 when the second roller 41 is decoupled from the auxiliary rail 6 and is rotated about the second rotation shaft 39 toward the front portion of the case 1.

As shown in FIG. 7, when external force is applied to the lifted basket 3 toward the rear portion of the case 1, the lever unit 50 may contact a front surface portion of the auxiliary rail 6 in order to prevent the basket 3 from moving rearward of the case 1.

Figure 8:
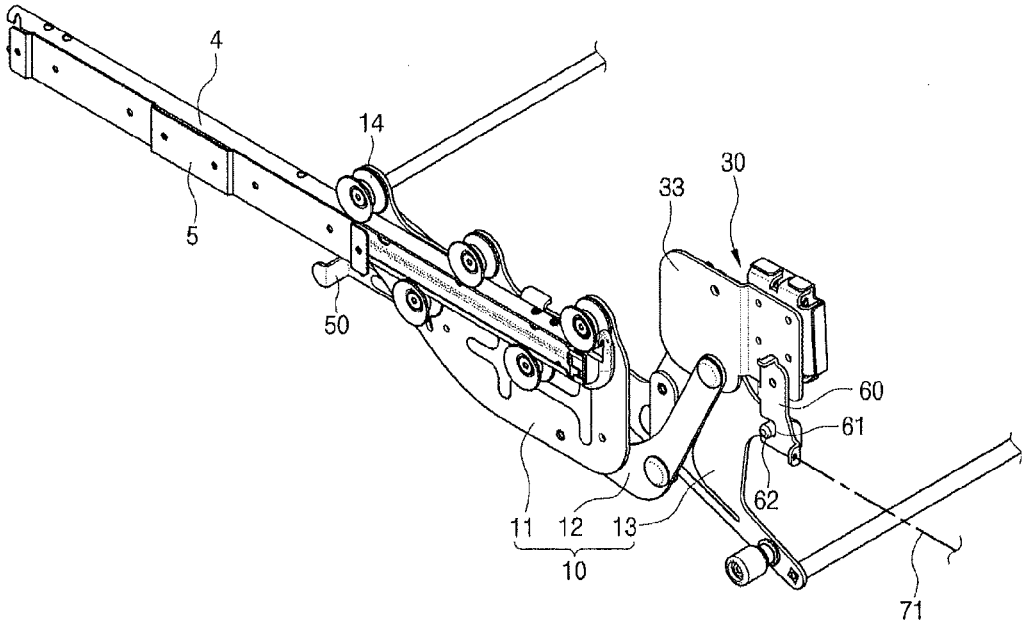
FIG. 8 is a perspective view illustrating a state of fastening a locking unit in the dishwasher according to an embodiment of the present disclosure while a partial configuration thereof is omitted.
Figure 9:
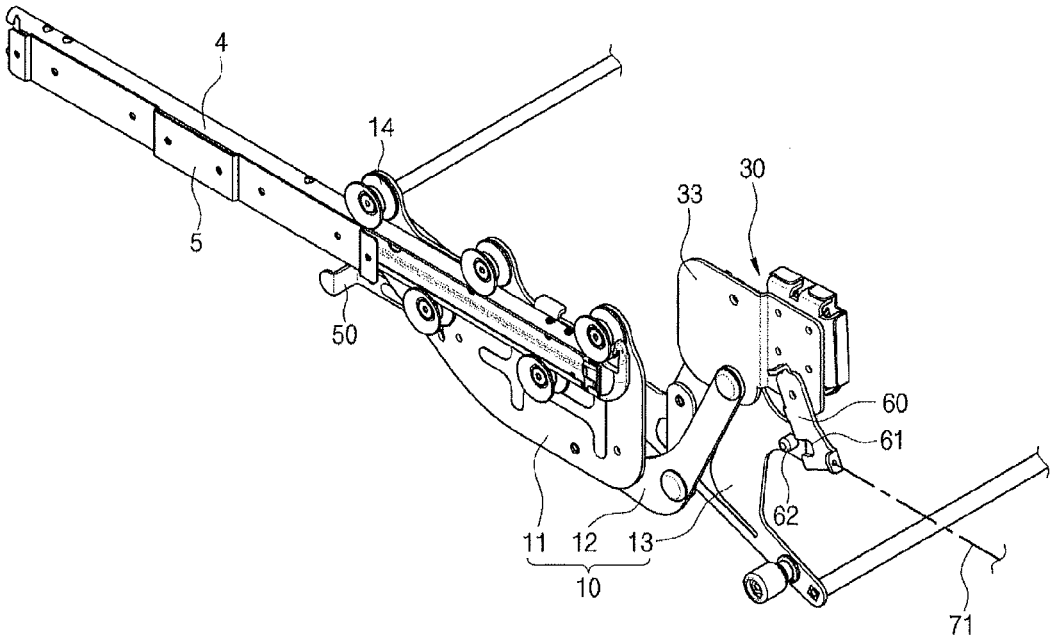
FIG. 9 is a perspective view illustrating a state of releasing the locking unit in the dishwasher according to an embodiment of the present disclosure while a partial configuration thereof is omitted.
Figure 10:
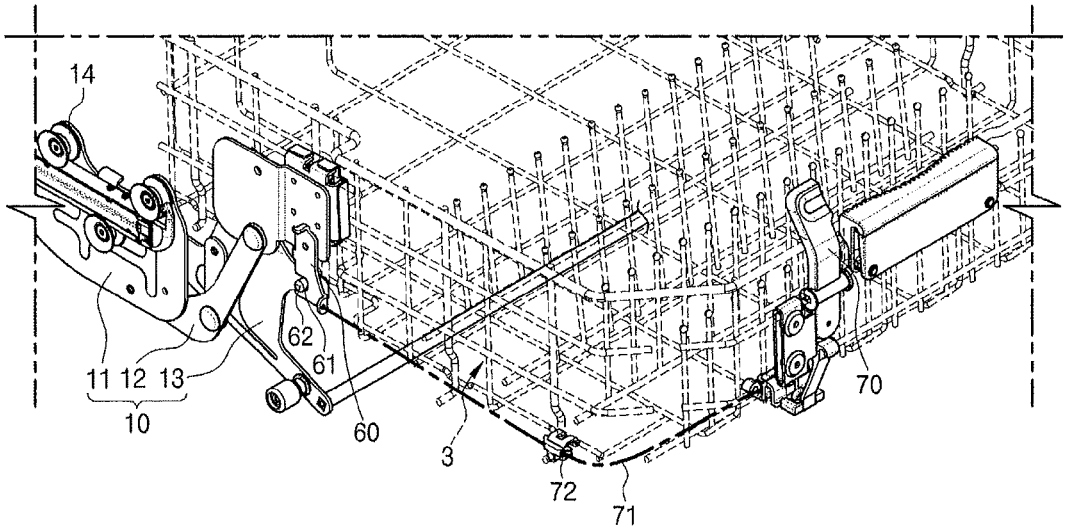
FIG. 10 is a perspective view illustrating a release unit in the dishwasher according to an embodiment of the present disclosure.

FIG. 8 is a perspective view illustrating a state of fastening a locking unit in the dishwasher according to an embodiment of the present disclosure while a partial configuration thereof is omitted. FIG. 9 is a perspective view illustrating a state of releasing the locking unit in the dishwasher according to an embodiment of the present disclosure while a partial configuration thereof is omitted. FIG. 10 is a perspective view illustrating a release unit in the dishwasher according to an embodiment of the present disclosure.

The dishwasher 100 may include a locking unit 60 and a release unit 70.

The locking unit 60 fixes or secures the lifted basket 3, and may be mounted outer portion of the basket holder portion 30.

Specifically, the locking unit 60 may be mounted, at one end portion thereof, to the third cover 33 of the basket holder portion 30, and may be provided, at the other end portion thereof, with a fixing groove 61 opened in a direction opposite to the withdrawal direction of the basket 3.

The fixing groove 61 engages with a fixing portion 62, which is formed at the third plate 13 and protrudes in a direction away from the basket 3, thereby enabling the lifted basket 3 to be fixed or secured.

The release unit 70 may move the locking unit 70 in the left and right directions.

Specifically, the release unit 70 is connected to the locking unit and moves the locking unit 70 in the withdrawal direction of the basket 3, thereby allowing the fixing groove 61 to be moved away from the fixing portion 62.

The locking units 60 may be respectively installed to the link units 10 mounted at both inner wall of the case 1.

As shown in FIG. 10, the release unit 70 may be connected to the locking unit 60 by a connection member 71, and may have a shape protruding toward a front upper end portion of the basket 3.

The connection member 71 is connected to the locking unit 60 by passing through a connection hole 72 provided at a side lower portion of the basket 3 from the release unit 70.

The connection member 71 pulls the locking unit 60 in the withdrawal direction of the basket 3 when the release unit 70 is pushed, and thus the third plate 13 enters a movable state.

The release unit 70 may be realized in the form of a lever or a button.

In addition to this, the locking unit 60 may be released by manually moving the same.

The fixing portion 62 is decoupled from the fixing groove 61 when the release unit 70 is operated, thereby enabling the third plate 13 to enter a state rotatable about the second rotation shaft 39. The first coupling shaft 21 moves upward of the reference line 53 when external force is applied to the basket 3, thereby enabling the basket 3 to drop or move downward.

As is apparent from the above description, a user may withdraw a lower basket without bending down and store objects to be washed by providing a lifting unit in a dishwasher.

It may be possible to stably and fixedly maintain a basket in a state in which the basket is lifted by providing a lever unit and a locking unit in a dishwasher.

It may be possible to prevent a basket from rapidly dropping or moving downward quickly by providing an auxiliary unit in a dishwasher.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a case;

a basket arranged within the case to receive one or more objects to be washed;

a rail unit configured to guide the basket such that the basket is withdrawn from or inserted into the case, the rail unit including a support fixed to an inner wall of the case and a rail moving forward or backward along the support while engaged with the support;

a link unit mounted to the basket to lift the basket and connected to the rail to guide the basket to be withdrawn from or inserted into the case;

an auxiliary unit connected to the link unit such that lifting force applied to the basket acts on the basket based on a position of the basket; and an auxiliary rail installed at the inner wall of the case while being spaced apart from the rail unit to prevent the basket from being lifted.

2. The dishwasher according to claim 1, wherein the link unit comprises:

a first plate coupled to a plurality of first rollers to move along the rail;

a second plate coupled to the first plate and coupled to a basket holder portion coupled to the basket;

a first rotation shaft being formed at a position at which the first plate and the second plate are coupled;

a third plate coupled to the second plate so as to be rotated together with the second plate; and a second rotation shaft being formed at a position at which the first plate and the third plate are coupled.

3. The dishwasher according to claim 2, wherein the auxiliary rail has a front end portion positioned farther rearward than that of the support.

4. The dishwasher according to claim 3, wherein the third plate has a second roller which moves along the auxiliary rail and is formed at an end portion thereof in a direction away from the second rotation shaft.

5. The dishwasher according to claim 4, wherein the third plate is rotated about the second rotation shaft toward a front portion of the case in order to lift the basket when the second roller is decoupled from the auxiliary rail toward the front portion of the case such that the link unit lifts the basket at a distal end portion of the rail withdrawn outward of the case.

6. The dishwasher according to claim 2, further comprising:

a first coupling shaft by which the auxiliary unit is mounted to the third plate; and a second coupling shaft by which the auxiliary unit is mounted to the first plate, wherein when the first coupling shaft is positioned below a reference line defined by the second coupling shaft and the second rotation shaft, the basket is lifted as the third plate is rotated about the second rotation shaft toward a front portion of the case.

7. The dishwasher according to claim 2, further comprising a lever unit which is provided between the auxiliary unit and the third plate and is mounted to the first plate, the lever unit being moved downward to a position reaching the auxiliary rail when the third plate is rotated about the second rotation shaft toward a front portion of the case.

8. The dishwasher according to claim 7, wherein when external force is applied to the lifted basket toward the rear portion of the case, the lever unit contacts a front surface portion of the auxiliary rail in order to prevent the basket from moving rearward of the case.

9. The dishwasher according to claim 2, further comprising a locking unit mounted outside the basket holder portion so as to secure the lifted basket.

10. The dishwasher according to claim 9, wherein the locking unit is mounted, at one end portion thereof, outer portion of the basket holder portion, and is provided, at the other end portion thereof, with a fixing groove opened in a direction opposite to a withdrawal direction of the basket such that the fixing groove engages with a fixing portion, which is formed at the third plate and protrudes in a direction away from the basket.

11. The dishwasher according to claim 10, further comprising a release unit, which is connected to the locking unit and moves the locking unit in the withdrawal direction of the basket, thereby allowing the fixing groove to be moved away from the fixing portion.

12. The dishwasher according to claim 11, wherein the fixing portion is decoupled from the fixing groove when the release unit is operated, thereby allowing the third plate to enter a state rotatable about the second rotation shaft, and when external force is applied to the basket, the basket moves downward until a first coupling shaft is positioned above a reference line defined by a second coupling shaft and the second rotation shaft.

13. The dishwasher according to claim 1, wherein the auxiliary unit uses at least one of expansion forces of a gas, a fluid, and a spring compressed within a cylinder, in order to relieve vibration or shock applied to the basket.

14. The dishwasher according to claim 1, wherein the auxiliary unit is configured such that the auxiliary unit is provided at the link unit.

15. A dishwasher comprising:

a case;

a basket arranged within the case to receive one or more objects to be washed;

a plurality of rail units configured to guide the basket such that the basket is withdrawn from or inserted into the case, the plurality of rail units including supports installed at both inner walls of the case and rails moving forward or backward along the supports while engaged with the supports;

a first link unit and a second link unit which are mounted to both side surface portions of the basket, respectively, to lift the basket, and connected to the plurality of rail units to guide the basket to be withdrawn from or inserted into the case;

a first auxiliary unit and a second auxiliary unit which are connected to the first link unit and the second link unit, respectively, such that lifting force applied to the basket acts on the basket based on a position of the basket, and auxiliary rails installed at both inner walls of the case while being spaced apart from the plurality of rail units to prevent the basket from being lifted when the basket is improperly withdrawn.

16. The dishwasher according to claim 15, wherein the first link unit and the second link unit comprise:

a first plate coupled to a plurality of first rollers to move along the rails;

a second plate coupled to the first plate and coupled to a basket holder portion coupled to the basket;

a first rotation shaft being formed at a position at which the first plate and the second plate are coupled; and a third plate coupled to the second plate by a fixing member so as to be rotated together with the second plate, a second rotation shaft being formed at a position at which the first plate and the third plate are coupled.

17. The dishwasher according to claim 16, wherein when a first coupling shaft by which the first auxiliary unit or the second auxiliary unit is mounted to the third plate is positioned below a reference line defined by a second coupling shaft by which the first auxiliary unit or the second auxiliary unit is mounted to the first plate and the second rotation shaft, the basket is lifted as the third plate is rotated about the second rotation shaft toward the front of the case.

18. The dishwasher according to claim 17, wherein in order to uniformly maintain force required to lift the basket and advance a point of time to lift the basket, the first coupling shaft moving closer to the reference line differs according to the first auxiliary unit and the second auxiliary unit.

19. The dishwasher according to claim 17, wherein the auxiliary rails have front end portions positioned farther rearward than those of the supports.

20. The dishwasher according to claim 19, further comprising a lever unit which is provided between at least one of the first and second auxiliary unit and the third plate and is mounted to the first plate, the lever unit being moved downward to a position reaching the corresponding auxiliary rail when the third plate is rotated about the second rotation shaft toward a front portion of the case.

21. The dishwasher according to claim 17, further comprising a locking unit, which is mounted, at one end portion thereof, on an outer portion of the basket holder portion so as to secure the lifted basket, and is provided, at the other end portion thereof, with a fixing groove opened in a direction opposite to a withdrawal direction of the basket such that the fixing groove engages with a fixing portion, which is formed at the third plate and protrudes in a direction away from the basket.

22. The dishwasher according to claim 21, further comprising a release unit, which is connected to the locking unit by a connection member and has a shape protruding toward a front upper end portion of the basket, wherein when the release unit is operated, the fixing groove is pulled in the withdrawal direction of the basket by the connection member so as to be away from the fixing portion.

* * * * *